US008992073B2

(12) United States Patent
Lefebvre et al.

(10) Patent No.: US 8,992,073 B2
(45) Date of Patent: Mar. 31, 2015

(54) DEVICE FOR AUTOMATIC ELIMINATION OF FIBERS ON THE IMPELLER OF A MIXER IN WASTEWATER TREATMENT PROCESS

(75) Inventors: Didier Lefebvre, Villeneuve d'Ascq (FR); Gael Poulleau, Villenauxe la Petite (FR); Antoine Godde, Beijing (CN)

(73) Assignee: Milton Roy Mixing, Somoreau (FR)

( * ) Notice: Subject to any disclaimer, the term of this patent is extended or adjusted under 35 U.S.C. 154(b) by 485 days.

(21) Appl. No.: 13/275,480

(22) Filed: Oct. 18, 2011

(65) Prior Publication Data

US 2012/0134231 A1 May 31, 2012

(30) Foreign Application Priority Data

Nov. 25, 2010 (EP) ..... 10306296

(51) Int. Cl.

| | |
|---|---|
| ***B01F 13/00*** | (2006.01) |
| ***B01F 7/00*** | (2006.01) |
| ***B08B 7/00*** | (2006.01) |
| ***B01F 3/12*** | (2006.01) |
| ***B01F 7/16*** | (2006.01) |
| ***B01F 15/00*** | (2006.01) |
| *B01F 3/00* | (2006.01) |

(52) U.S. Cl.

CPC ..... *B08B 7/00* (2013.01); *B01F 3/1221* (2013.01); *B01F 7/16* (2013.01); *B01F 15/00019* (2013.01); *B01F 15/00201* (2013.01); *B01F 15/00435* (2013.01); *B01F 2003/0028* (2013.01); *B01F 2015/00636* (2013.01); *B01F 2215/0052* (2013.01); *Y10S 366/601* (2013.01)

USPC ..... 366/348; 366/279; 366/601

(58) Field of Classification Search

USPC ..... 366/348, 330.1, 142, 96, 97, 98, 100, 366/279

See application file for complete search history.

(56) References Cited

U.S. PATENT DOCUMENTS

| | | | | |
|---|---|---|---|---|
| 2,894,551 | A | 7/1959 | Fritz | |
| 3,318,450 | A | 5/1967 | Watson et al. | |
| 3,482,695 | A | 12/1969 | Hansen et al. | |
| 3,961,758 | A * | 6/1976 | Morgan | 241/46.11 |
| 4,421,414 | A | 12/1983 | Holupko | |
| 4,502,958 | A | 3/1985 | Sasaki | |
| 4,608,157 | A | 8/1986 | Graves | |
| 4,883,412 | A | 11/1989 | Malizard et al. | |
| 5,149,423 | A | 9/1992 | Piepho | |
| 5,244,360 | A | 9/1993 | Lefebvre | |

(Continued)

FOREIGN PATENT DOCUMENTS

| | | |
|---|---|---|
| DE | 4002527 | 8/1990 |
| GB | 2230709 | 10/1990 |

(Continued)

OTHER PUBLICATIONS

EP Search Report dated May 31, 2011.

*Primary Examiner* — Tony G Soohoo
*Assistant Examiner* — Anshu Bhatia
(74) *Attorney, Agent, or Firm* — Carlson, Gaskey & Olds P.C.

(57) ABSTRACT

A method and apparatus is disclosed for maintaining fluid in suspension in a mixing tank including particles includes providing a reversible mixer, rotating the mixer in a normal direction in which particles buildup on the mixer, and, rotating the mixer in an abnormal direction to shed the particles from the mixer.

3 Claims, 2 Drawing Sheets

(56) References Cited

U.S. PATENT DOCUMENTS

| | | | | |
|---|---|---|---|---|
| 5,727,742 | A * | 3/1998 | Lawson | 241/199.12 |
| 5,755,966 | A | 5/1998 | Mackrle et al. | |
| 6,179,991 | B1 | 1/2001 | Norris et al. | |
| 6,378,790 | B1 | 4/2002 | Paterson et al. | |
| 6,458,268 | B1 | 10/2002 | Grandprey et al. | |
| 6,609,821 | B2 * | 8/2003 | Wulf et al. | 366/348 |
| 6,758,592 | B2 * | 7/2004 | Wulf et al. | 366/348 |
| 7,662,281 | B1 | 2/2010 | Longo | |
| 7,841,764 | B2 * | 11/2010 | Wulf et al. | 366/142 |
| 2003/0178375 | A1 * | 9/2003 | Sharpe et al. | 210/768 |
| 2005/0029174 | A1 | 2/2005 | Collins | |
| 2005/0093246 | A1 | 5/2005 | Dietle et al. | |

FOREIGN PATENT DOCUMENTS

| | | |
|---|---|---|
| JP | 63294933 | 12/1988 |
| WO | 02/34209 | 5/2002 |
| WO | 2006079228 | 8/2006 |

* cited by examiner

DEVICE FOR AUTOMATIC ELIMINATION OF FIBERS ON THE IMPELLER OF A MIXER IN WASTEWATER TREATMENT PROCESS

CLAIM TO PRIORITY

This application claims priority to European Patent Application No. 10306296.4, which was filed Nov. 25, 2010.

BACKGROUND

This application relates to wastewater treatment, and more particularly to elimination of fibers on a mixer impeller in wastewater treatment. Sewage treatment involves the removal of contaminants from waste water and household sewage to produce solid or semisolid waste and an effluent suitable for discharge back into the environment. Sewage is created by residential, institutional, commercial and industrial establishments and includes household waste, liquid from toilets, baths, showers, kitchens, sinks, etc.

Conventional sewage treatment may involve primary, secondary and tertiary treatment steps. During primary treatment, sewage is held in a basin where heavy solids generally settle and light contaminants float to the surface. The sediment and floating materials are removed and the remaining liquid may be discharged or subject to secondary treatment. Secondary treatment generally removes dissolved and suspended biological matter and is performed by introducing micro organisms in a managed habitat. Secondary treatment may require a separation process to remove the micro organisms from the water prior to discharge or to tertiary treatment. In tertiary treatment treated water is sometimes disinfected chemically or physically prior to discharge to the environment.

Many municipal plants churn the sewage constantly during treatment steps to encourage separation and to introduce oxygen to allow the micro organisms to consume the biodegradable soluble organic contaminants like sugars, fats, etc. Some systems use aerated lagoons in which an electric motor driven impeller draws air into the water to allow the micro organisms to function efficiently.

SUMMARY

According to an exemplar method disclosed herein for maintaining fluid in suspension in a mixing tank including particles includes providing a reversible mixer, rotating the mixer in a normal direction in which particles buildup on the mixer, and, rotating the mixer in an abnormal direction to shed the particles from the mixer.

According to a further exemplar disclosed herein an apparatus for maintaining fluid in suspension in a mixing tank including fibers includes a reversible mixer and a controller providing commands to the mixer to rotate in a normal direction in which fibers may buildup on the mixer, and the controller providing commands to the mixer to rotate in an abnormal direction to shed the fibers from the mixer.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
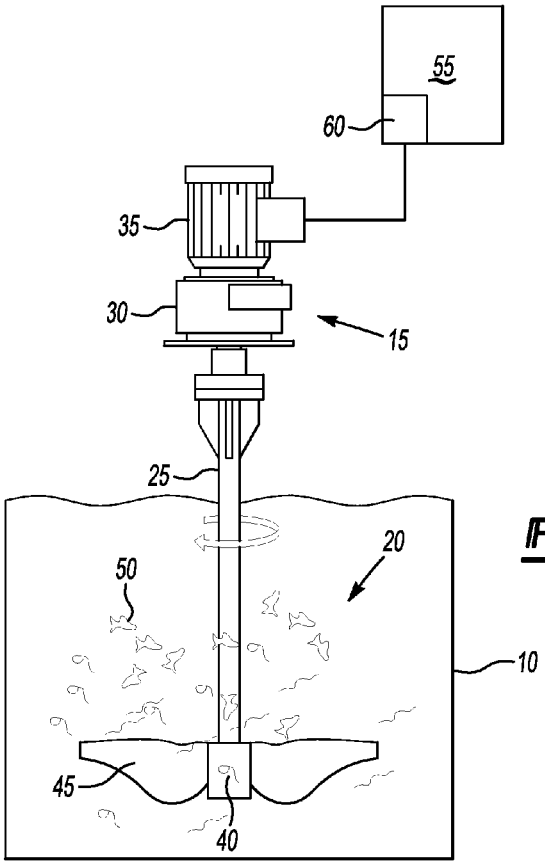
FIG. 1 shows a motor driving a blade attached to a hub within a sewage treatment containment area.

Referring now to FIG. 1, a mixing tank 10 for a waste water treatment plant (not shown) in which a mixer 15 is fitted in the mixing tank 10. The mixer 15 keeps fine particles 20 including fibers 50 in suspension and allows proper aeration and homogenation in the mixing tank 10. The fibers 50 may come from textiles, hair, paper, tissues or the like. The fibers 50 may have many properties and behaviors, for instance, they may be short, long, curled or elastic.

The mixer 15 includes a shaft 25, a gear box 30, a reversible motor 35, a hub 40 and an impeller 45. The mixer 15 is controlled by controller 55.

Figure 2:
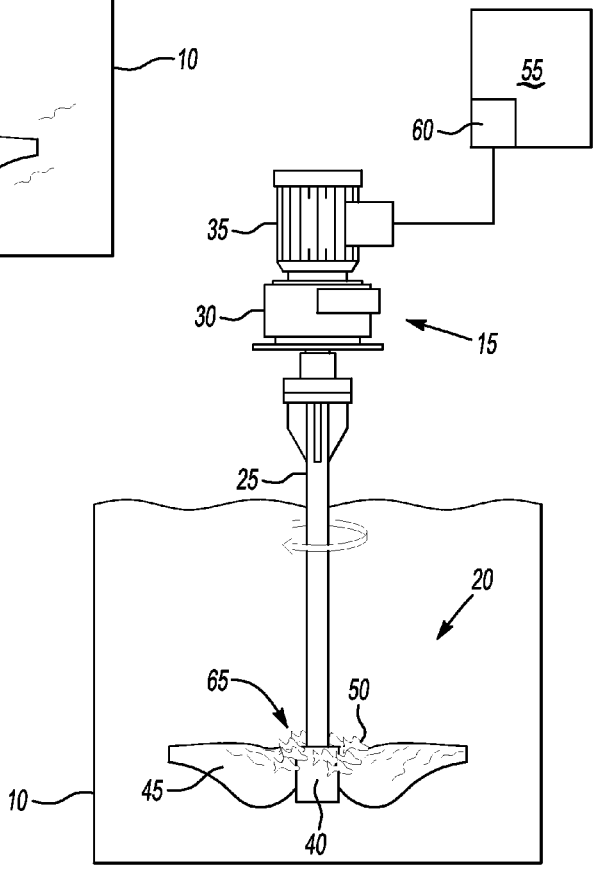
FIG. 2 shows a motor of FIG. 1 contaminated by fibers.

Referring now to FIG. 2, over time, the particles 20 including fibers 50 may become entrapped around the shaft 25, hub 40 and the impeller 45 and may build up much in the same way in which wool thread is made. For instance, the fibers 50 may be "spun" like wool thread creating stringy snags 65 (see FIG. 2) that may wind around the shaft 25, hub 40 and the impeller 45. If the fiber 50 is allowed to build up around the shaft 25, hub 40 and the impeller 45 there may be unbalances and vibrations on the shaft 25, hub 40 and the impeller 45 that increase the power required which may cause a mixer to stop and mechanical damage may occur. For instance, the gear box 30 may break.

While impellers 45 may be designed to shed these fibers 50 and avoid the problems that may occur due to the entrapment of fibers 50, changing the shape of the impeller 45 might make the impeller inappropriate for use in waste treatment. That is, a redesigned impeller (not shown) may change the absorbed power and the hydrodynamics that is presently provided by the impeller 45. In such a situation, a redesigned impeller (not shown) may not be able to provide smooth flow if flash mixing for high shear or flocculation is required. Combining an impeller 45 that is able to shed the fiber and provide the specific functions required by the mixer 15, including energy savings, has not yet been found.

Figure 3:
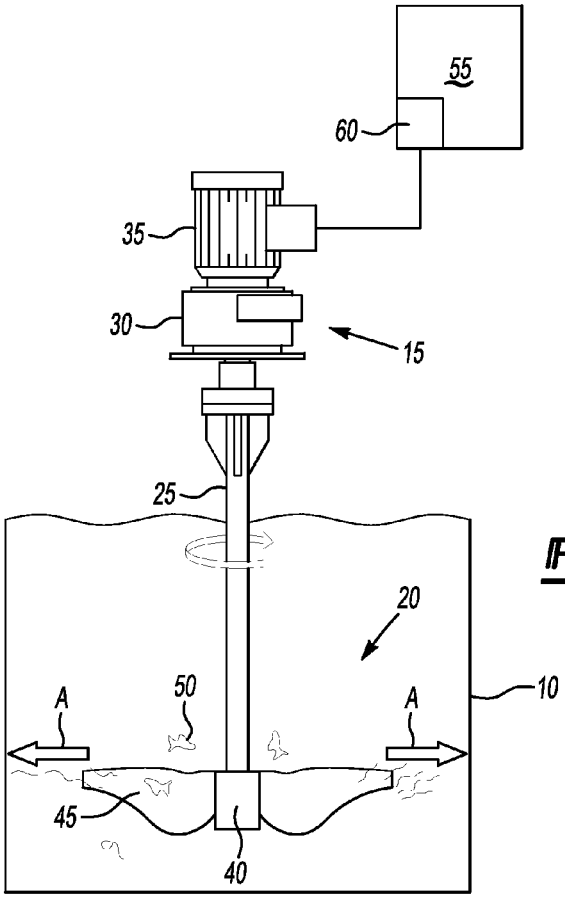
FIG. 3 shows the motor of FIG. 2 in which the rotor is driven in an opposite direction to remove fibers attached to the blade and hub.

Referring now to FIG. 3, if fibers 50 are wrapped around the shaft 25, hub 40 and the impeller 45 due to the normal, clockwise rotation of the impeller 45, the controller 55 may command the shaft 25, hub 40 and the impeller 45 to rotate in a counter-clockwise direction, that is, in an abnormal direction of rotation.

The controller 55 may require abnormal rotation on a regular basis. For example, for every hour of normal, clockwise rotation, the controller 55 may provide commands to the mixer 15 that may be rotated in an abnormal counter-clockwise direction for a period of time such as fifteen minutes. The mixer 15 may also be sensor controlled. For instance, the controller 55 may have a sensor 60 therein that senses excessive drag on the shaft 25, hub 40 and the impeller 45 by sensing an increase in voltage or current required by the motor 35. If such increase in voltage or current is sensed, the controller may provide commands to the mixer 15 to reverse rotation to shed the particles 20 including fibers 50 and unwind any snags 65 for a period of time. Other types of sensors regarding a buildup of particles 20 including fibers 50 are contemplated herein.

Figure 4:
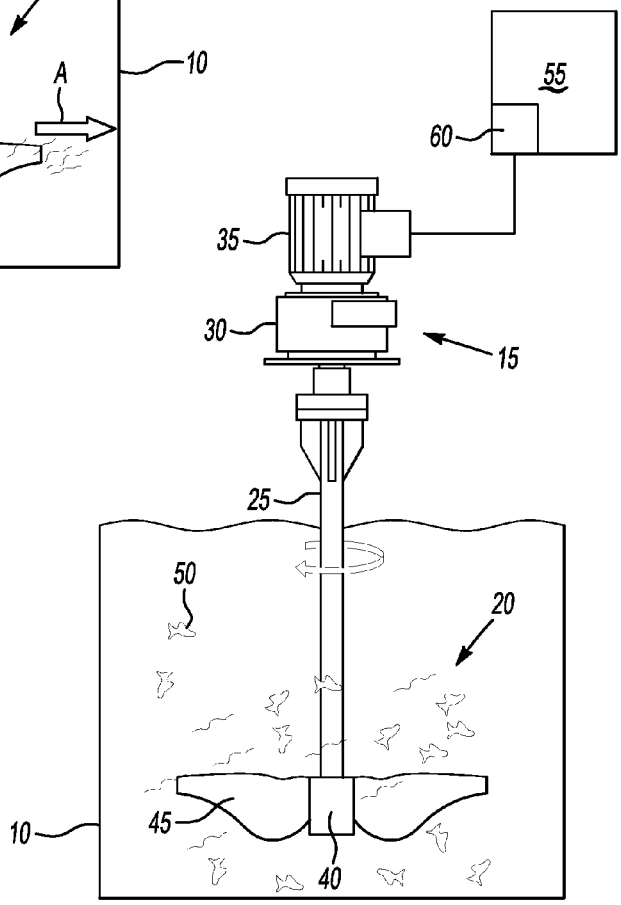
FIG. 4 shows a clockwise rotation where the fibers are suspended in a media as shown in FIG. 1.

The reverse or abnormal rotation of the shaft 25, hub 40 and the impeller 45 pushes the particles 20 and fibers 50, as exhibited by arrows A away from the shaft 25, hub 40 and the impeller 45 due to centrifugal forces. During the time period, the mixer 15 operates in the abnormal or reverse direction of rotation, the presence of particles 20 and fibers 50 are minimized and the mixer 15 can operate again in the normal direction (see FIG. 4) and the controller 55 so instructs the mixer 15 to rotate in a normal direction.

Removing the particles 20 and the fibers 50 from the mixer 15 by means of counter-clockwise rotation minimizes power and operation costs; minimizes vibrations and loads caused by overloaded and/or an unbalanced shaft 25, hub 40 or the impeller 45 that may damage the mixer 15 and require a waste water treatment plant to shut down; and, minimizes potentially hazardous manual labor to clean the shaft 25, hub 40 and the impeller 45. Further, no extra system, such as a scraper (not shown), is added into the water and the efficiency of the mixer 15 is not impaired.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

The invention claimed is:

1. A method for maintaining fluid in suspension in a mixing tank including fibers, comprising:

providing a reversible mixer comprising a shaft and an impeller, wherein the mixer is provided within a mixing tank for a waste water treatment plant;

rotating the mixer in a normal direction in which fibers build up on the mixer;

sensing if a buildup of fibers on the mixer exists, wherein the sensing includes sensing a voltage or a current drawn from the mixer;

rotating the mixer in an abnormal direction to shed the fibers from the mixer if the buildup exists; and rotating the mixer in the normal direction to maintain the fibers in suspension after shedding the fibers from the mixer.

2. The method of claim 1 further comprising:

rotating the mixer in the normal direction for a first amount of time; and rotating the mixer in the abnormal direction for a second amount of time, wherein the second amount of time is less than the first amount of time.

3. The method of claim 1 wherein the fibers include fibers from at least one of textiles, hair, paper, and tissues.

* * * * *